United States Patent [19]

Li et al.

[11] Patent Number: 4,566,525

[45] Date of Patent: Jan. 28, 1986

[54] NOZZLE ASSEMBLY

[75] Inventors: Hsin L. Li, Parsippany; Thomas K. Morris, Cedar Knolls; David B. Seal, North Caldwell; Edward V. Limoncelli, Morristown, all of N.J.

[73] Assignee: Allied Corporation, Morris Township, Morris County, N.J.

[21] Appl. No.: 701,791

[22] Filed: Feb. 14, 1985

Related U.S. Application Data

[63] Continuation of Ser. No. 491,471, May 4, 1983, abandoned.

[51] Int. Cl.[4] ..... B22D 11/00

[52] U.S. Cl. ..... 164/463; 164/423; 222/593

[58] Field of Search ..... 114/463, 462, 423, 337, 114/437; 222/591, 593, 606, 607

[56] References Cited

U.S. PATENT DOCUMENTS

| | | | |
|---|---|---|---|
| 3,567,082 | 3/1971 | Tinnes | 222/606 |
| 3,604,598 | 9/1971 | Kappmeyer | 222/591 |
| 3,861,571 | 1/1975 | Franklin | 164/337 |
| 4,142,571 | 3/1979 | Narasimhan | 164/463 |
| 4,154,380 | 5/1979 | Smith | 222/591 |
| 4,433,715 | 2/1984 | Smith | 164/423 |

FOREIGN PATENT DOCUMENTS

| | | | |
|---|---|---|---|
| 1126568 | 3/1962 | Fed. Rep. of Germany | 164/437 |
| 846077 | 7/1981 | U.S.S.R. | 164/437 |

*Primary Examiner*—Nicholas P. Godici
*Assistant Examiner*—G. M. Reid
*Attorney, Agent, or Firm*—Paul Yee; Gerhard H. Fuchs; James Riesenfeld

[57] ABSTRACT

A nozzle assembly for casting continuous metal strips includes a nozzle for extruding molten metal. The nozzle has a nozzle body, a nozzle inlet opening, a nozzle exit orifice and a nozzle mounting surface located proximate to the nozzle inlet. A reservoir contains the molten metal and is in fluid communication with the nozzle. The reservoir has a reservoir outlet opening for flowing molten metal therethrough and has a reservoir mounting surface located proximate to the reservoir outlet. The reservoir mounting surface is adapted to mate with the nozzle mounting surface and allow a relative, sliding-type movement therebetween due to a differing thermal expansion of the nozzle relative to the reservoir. A heat resistant seal between the nozzle mounting surface and the reservoir mounting surface minimizes molten metal leakage therebetween, and a force mechanism resiliently urges the nozzle mounting surface toward the reservor mounting surface to mate the nozzle and reservoir together.

12 Claims, 7 Drawing Figures

FIG. 5
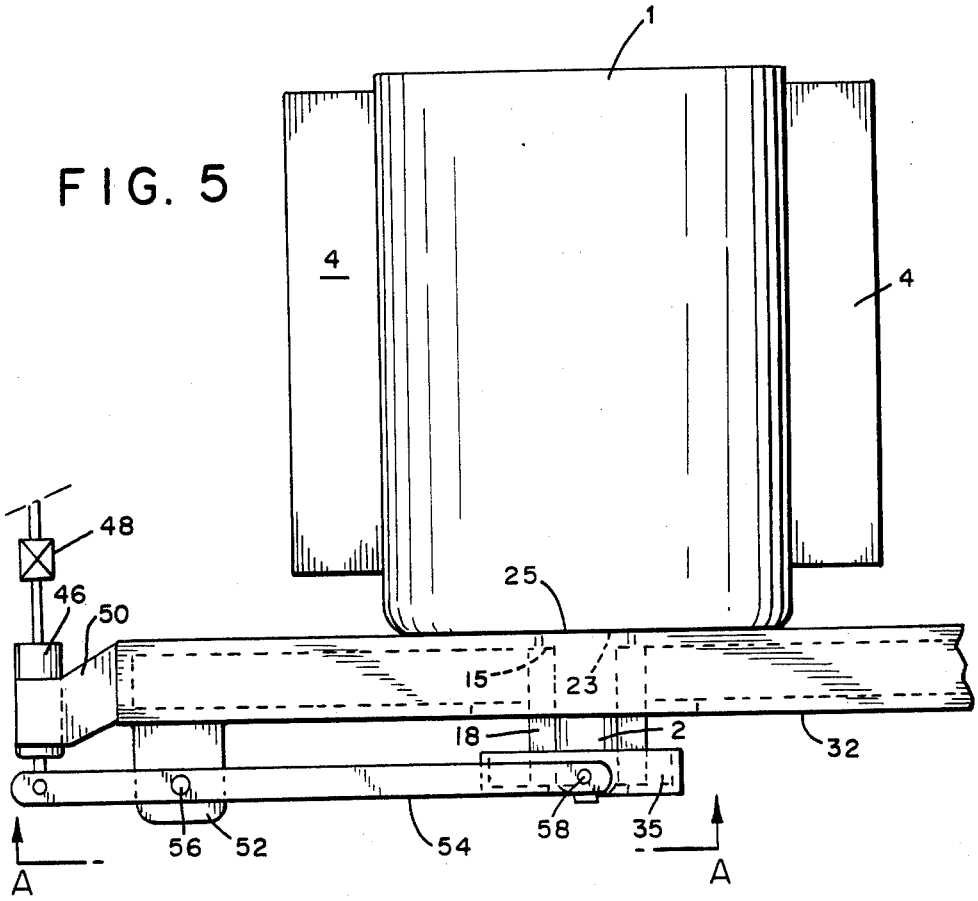
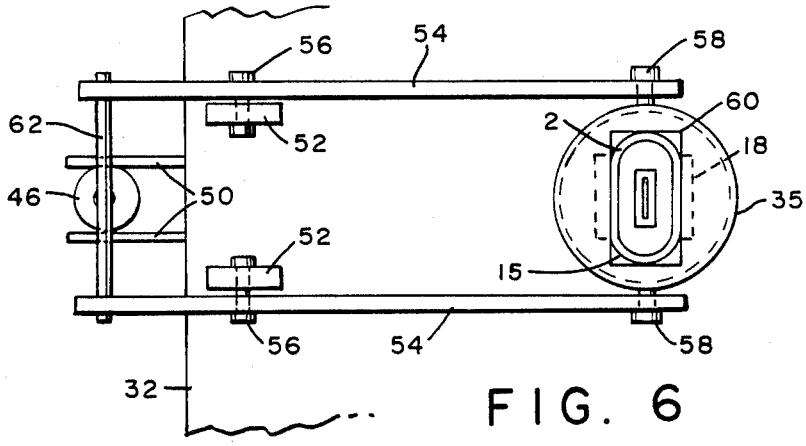
FIG. 6

NOZZLE ASSEMBLY

This application is a continuation of application Ser. No. 491,471 filed May 4, 1983, abandoned Feb. 14, 1985.

BACKGROUND OF THE INVENTION

1. Field of the Invention

The invention relates to an apparatus for casting metal strip. More particularly, the invention relates to a nozzle assembly system for mounting a casting nozzle to a crucible reservoir to cast continuous metal strip.

2. Description of the Prior Art

In the production of continuous metal strip, molten metal has typically been extruded from a pressurized reservoir through a nozzle on to a high speed, rotating quench surface. Representative apparatus are shown in U.S. Pat. No. 4,142,571 for "continuous casting method for metallic strips" issued Mar. 6, 1978 to M. Narasimhan.

When continuously casting metal strip over extended periods of time, it has been desirable to connect a replaceable nozzle to a separate crucible capable of holding a large quantity of molten metal. The resultant multipiece assembly has required sealing means to prevent leakage of molten metal between the component parts. A conventional nozzle assembly is representatively shown in U.S. Pat. No. 4,154,380 issued May 15, 1979 to W. Smith.

The sealing means of Smith is comprised of a tapered, frusta-conical surface on the casting nozzle which is adapted to mate with a corresponding tapered surface along the outlet passage from the crucible. The weight of the nozzle plus the metallostatic pressure head holds the mated, tapered surfaces together. These surfaces, however, required precise machining to obtain the required degree of sealing effectiveness. In addition, the closely mated surfaces do not allow for any differences in thermal expansion between the crucible and the nozzle body, particularly where the crucible and nozzle body are constructed from different refractory materials having different coefficients of thermal expansion. As a result, the nozzle can expand more than the crucible outlet passage opening, and very large lateral, side to side, forces developed between the crucible and nozzle have often caused the nozzle to fracture. If the nozzle should fracture severely, the flow of molten metal is no longer restricted by the relatively small nozzle extrusion orifice; large volumes of molten metal may then escape and damage the casting surface and any nearby auxiliary support equipment.

Thus, conventional nozzle assemblies, such as those taught by Smith, have lacked a mechanism for preventing nozzle fracture due to thermal expansion of the nozzle against the crucible and have lacked a safety device to prevent the sudden escape of large volumes of molten metal from a fractured nozzle.

SUMMARY OF THE INVENTION

The invention provides an efficient, leak resistant nozzle assembly system for casting continuous metal strip. The apparatus of the invention includes a nozzle means for extruding molten metal. The nozzle means has a nozzle body, a nozzle inlet opening, a nozzle exit orifice and a nozzle mounting surface located on the nozzle body proximate to the nozzle inlet. A reservoir means for containing the molten metal is in fluid communication with the nozzle means. The reservoir means has a reservoir opening for flowing the molten metal therethrough and has a reservoir mounting surface located proximate to the reservoir outlet. The reservoir mounting surface is adapted to mate with the nozzle mounting surface and allow a relative, sliding-type movement therebetween due to a differing thermal expansion of the nozzle relative to the reservoir means. Heat resistant sealing means between the nozzle mounting surface and the reservoir mounting surface minimize molten metal leakage therebetween, and a force means for resiliently urging the nozzle mounting surface toward the reservoir mounting surface mates the nozzle and reservoir means together.

In accordance with the invention, there is further provided a method for casting continuous metal strip. A supply of molten metal is contained in a reservoir means which has a reservoir mounting surface located proximate to a reservoir outlet. Molten metal is extruded from a nozzle means which is in fluid communication with the reservoir means and has a nozzle mounting surface located proximate to a nozzle inlet. The nozzle mounting surface and the reservoir mounting surface mate together and allow a relative, sliding-type movement therebetween due to a differing thermal expansion of the nozzle means relative to the reservoir means. The region between the nozzle mounting surface and the reservoir mounting surface is sealed to minimize molten metal leakage therebetween, and the nozzle mounting surface is resiliently urged toward the reservoir mounting surface to mate the nozzle and reservoir means together.

The invention advantageously allows differential thermal expansion between the nozzle body and reservoir. In particular, the lateral clearance avoids lateral contact between the nozzle and reservoir, and the planar mounting surfaces allow an amount of relative movement along the mated, parallel mounting surfaces to avoid the build up of excessive lateral stresses that coul fracture the nozzle or crucible. Additionally, the force means, which resiliently urges the nozzle and reservoir means together, allows a lengthwise, longitudinal thermal expansion of the nozzle without a buildup of excessive internal stresses. The safety device prevents a sudden escape of excessive amounts of molten metal if the nozzle should become inadvertently fractured.

Thus, compared to conventional nozzle assemblies without planar mounting surfaces, without a resilient force means or without a safety device, the present invention more reliably and more efficiently casts continuous metal strip. The invention minimizes nozzle fracturing due to thermal stresses developed between the nozzle and the reservoir means and minimizes the escape of molten metal from the reservoir if the nozzle should become inadvertently fractured.

BRIEF DESCRIPTION OF THE DRAWINGS

The invention will be more fully understood and further advantages will become apparent when reference is made to the following detailed description of the preferred embodiment of the invention and the accompanying drawings in which:

FIG. 5 shows a side elevational view of a nozzle mounted externally to a crucible with a forced means comprised of a pneumatic actuator;

FIG. 6 shows a bottom plan view of the pheumatic actuator mechanism taken in the direction A—A of FIG. 5.

DESCRIPTION OF THE PREFERRED EMBODIMENTS

The present invention is suitable for casting continuous strip of crystalline or amorphous metal. While the preferred embodiments are described with respect to casting amorphous metal alloy strip, it is readily apparent that the invention can be easily adapted to cast crystalline metal strip as well.

For the purposes of the present invention and as used in the specification and claims, a "strip" is a slender body in which the transverse dimensions are much smaller than the length. Thus, a strip includes wire, ribbon and sheet of regular or irregular cross-section.

Figure 7:
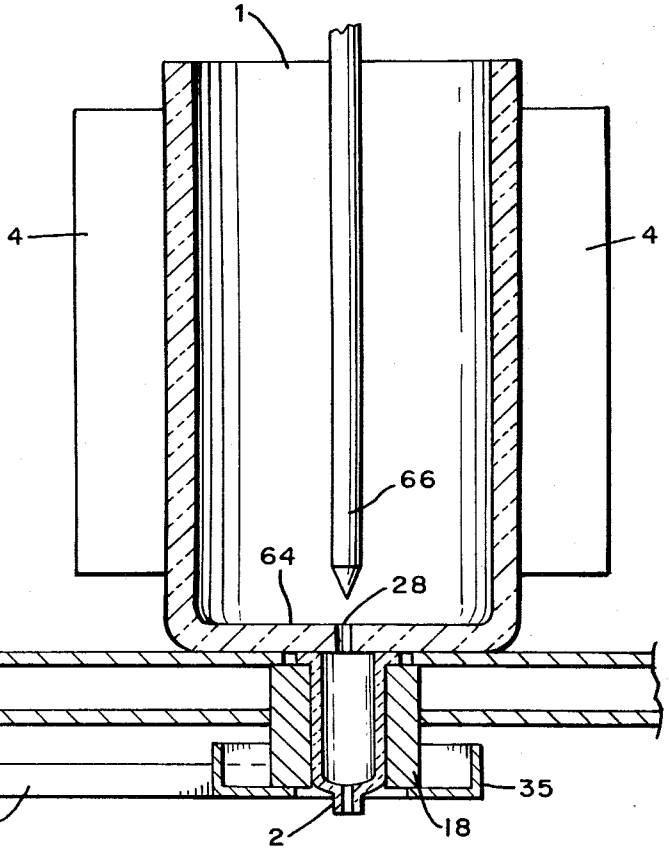
FIG. 7 shows a representative cross-sectional view of the apparatus shown in FIG. 5.
Figure 1:
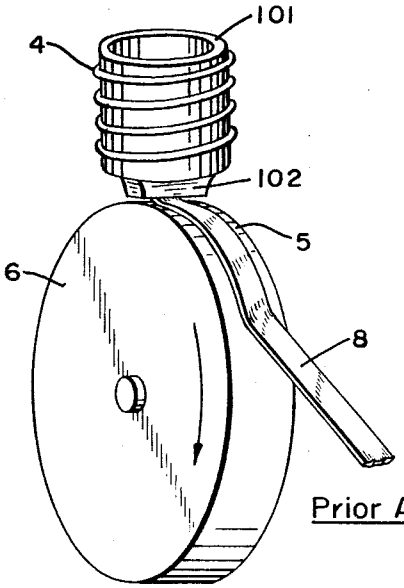
Prior Art FIG. 1
FIG. 1 shows a representative prior art apparatus for casting continuous metal strip.

FIG. 1 shows a typical prior art apparatus for the continuous casting of metal strip to point out the general use of the present invention. Molten alloy contained in crucible 101 is heated with a heating element 4. Pressurization of the crucible with an inert gas extrudes a stream of molten metal from nozzle 102, located at the base of the crucible, onto quench surface 5 of rotating quench wheel 6. The solidified moving strip 8 after its break-away point from the quench wheel is routed onto a winding wheel (not shown).

When casting a strip of amorphous, glassy metal or when casting a strip of certain crystalline metal alloys, the extruded metal is quenched at an extremely rapid rate of at least about $10^4$°C./sec, and the solidified strip moves rapidly off the quench wheel at a speed ranging from about 400–2200 m/min. The cast strip is quite thin, typically about 25–100 microns thick, but considerable selectivity may be exercised with respect to the width and cross-section.

Figure 2:
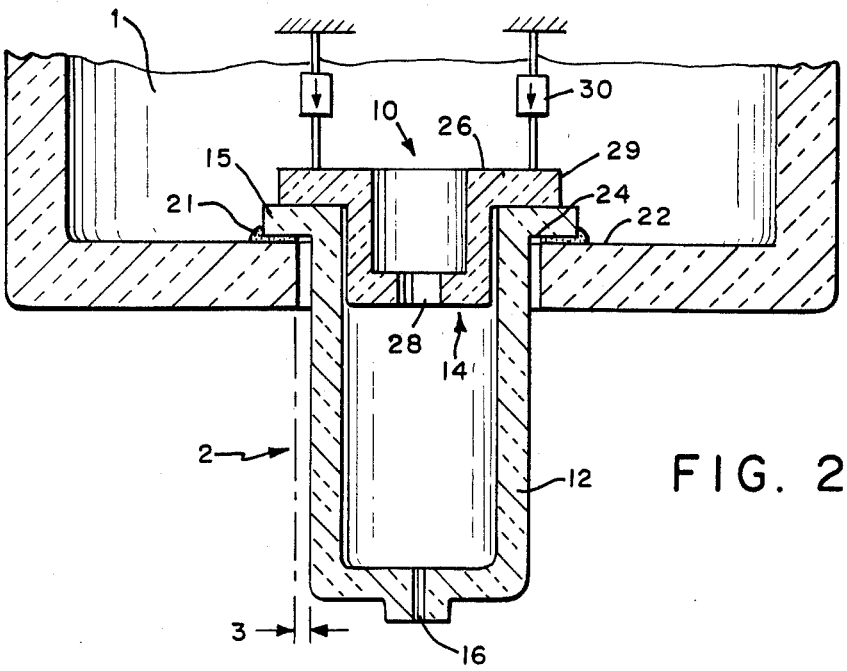
FIG. 2 shows a representative cross-sectional view of a nozzle mounted internally to a crucible.

FIG. 2 shows a representative nozzle assembly for casting continuous metal strip in which a nozzle means for extruding molten metal is shown generally at 2. The nozzle has a nozzle body 12, a nozzle inlet opening shown generally at 14, a nozzle exit orifice 16 and a nozzle mounting surface, such as substantially planar surface 24. A reservoir means, comprised of crucible 1, contains molten metal and includes a reservoir outlet opening, shown generally at 10, for flowing the molten metal therethrough. A reservoir mounting surface, such as substantially planar surface 22, is located on the reservoir means proximate to the reservoir outlet. Reservoir surface 22 is adapted to mate with nozzle surface 24 and allow a relative, sliding-type movement therebetween due to a differing thermal expansion of nozzle 2 relative to crucible 1. In addition, the reservoir crucible is adapted to provide a lateral clearance distance 3 between nozzle 2 and crucible 1. The lateral clearance prevents lateral contact caused by a differing thermal expansion of nozzle 2 relative to crucible 1. A safety device is comprised of a cover member 26 having a constricted passage 28 therethrough. Cover 26 has a peripheral, outwardly extending cover flange 29 adapted to mount at the inlet portion 14 of nozzle 2 to limit the flow of molten metal from crucible 1 into the nozzle. A resilient, heat resistant sealing means, such as a boron nitride paste adhesive 21, is interposed between nozzle mounting surface 24 and crucible mounting surface 22 to minimize molten metal leakage therebetween. Force means 30 resiliently urges the nozzle mounting surface toward the crucible mounting surface to mate the nozzle and crucible together.

The apparatus of the invention advantageously minimizes any stresses caused by differing amounts of thermal expansion between nozzle 2 and crucible 1. In particular, lateral clearance 3 avoids lateral contact between the nozzle and crucible, and the planar mounting surfaces 22 and 24, disposed substantially parallel to each other, allows relatively free, sliding-type movement between the nozzle and the crucible. Surface shear stresses are present, but bulk stresses that could crack and break the nozzle are minimized. In addition, the resilient force means allows longitudinal thermal expansion while mating and holding together nozzle 2 and crucible 1 with a force sufficient to prevent molten metal leakage therebetween.

The nozzle assembly illustrated in FIG. 2 is an internally mounted nozzle. Thus, the reservoir mounting surface is an inwardly facing surface 22 of crucible 1, and the nozzle mounting surface is a nozzle body surface 24 facing in the direction of the intended flow of molten metal. Preferably, nozzle mounting surface 24 is located on a surface of a nozzle flange 15 which extends radially outward along a peripheral edge of nozzle body 12. While force means 30 can be comprised of a distinct mechanical mechanism, the force means in this embodiment is preferably provided by the weight of nozzle 2 and cover 26 along with the metallostatic pressure head of any molten metal contained in crucible 1.

Figure 3:
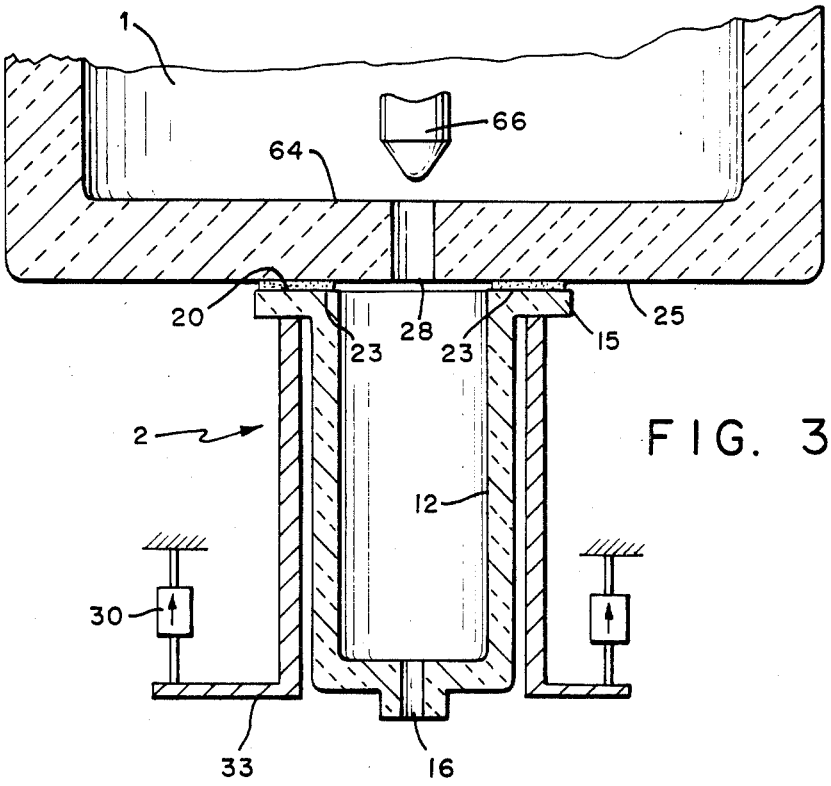
FIG. 3 shows a representative cross-sectional view of a nozzle mounted externally to a crucible.

FIG. 3 shows an externally mounted nozzle which compared to the internally mounted nozzle is more easily removed and serviced, particularly when there is molten metal in crucible 1. A stopper rod 66 can be employed to block passage 28 while the nozzle is being preheated or serviced. In this embodiment, the reservoir mounting surface is an outwardly facing surface 25 of crucible 1, and the nozzle mounting surface is a nozzle body surface 20 facing opposite to the direction of the intended flow of molten metal. Preferably, nozzle mounting surface 23 is located on a surface of nozzle flange 15 to increase the mated surface area between the nozzle and crucible. The sealing means for the externally mounted nozzle is preferably comprised of a gasket composed of a ceramic fiber, such as alumina silica. Such a gasket is easier to handle than a paste material and still allows the needed amount of movement between planar surfaces 20 and 25. The externally mounted nozzle advantageously eliminates the need for a separate cover for the safety device. With this embodiment, the cover member of the safety device is comprised of the bottom wall 64 of crucible 1, and constricted outlet passage 28 which communicates through bottom wall 64 limits the flow of molten metal from crucible 1. The externally mounted nozzle, however, does require a force means 30 comprised of a distinct mechanical mechanism 33 to hold the nozzle and crucible together and maintain alignment therebetween.

Figure 4:
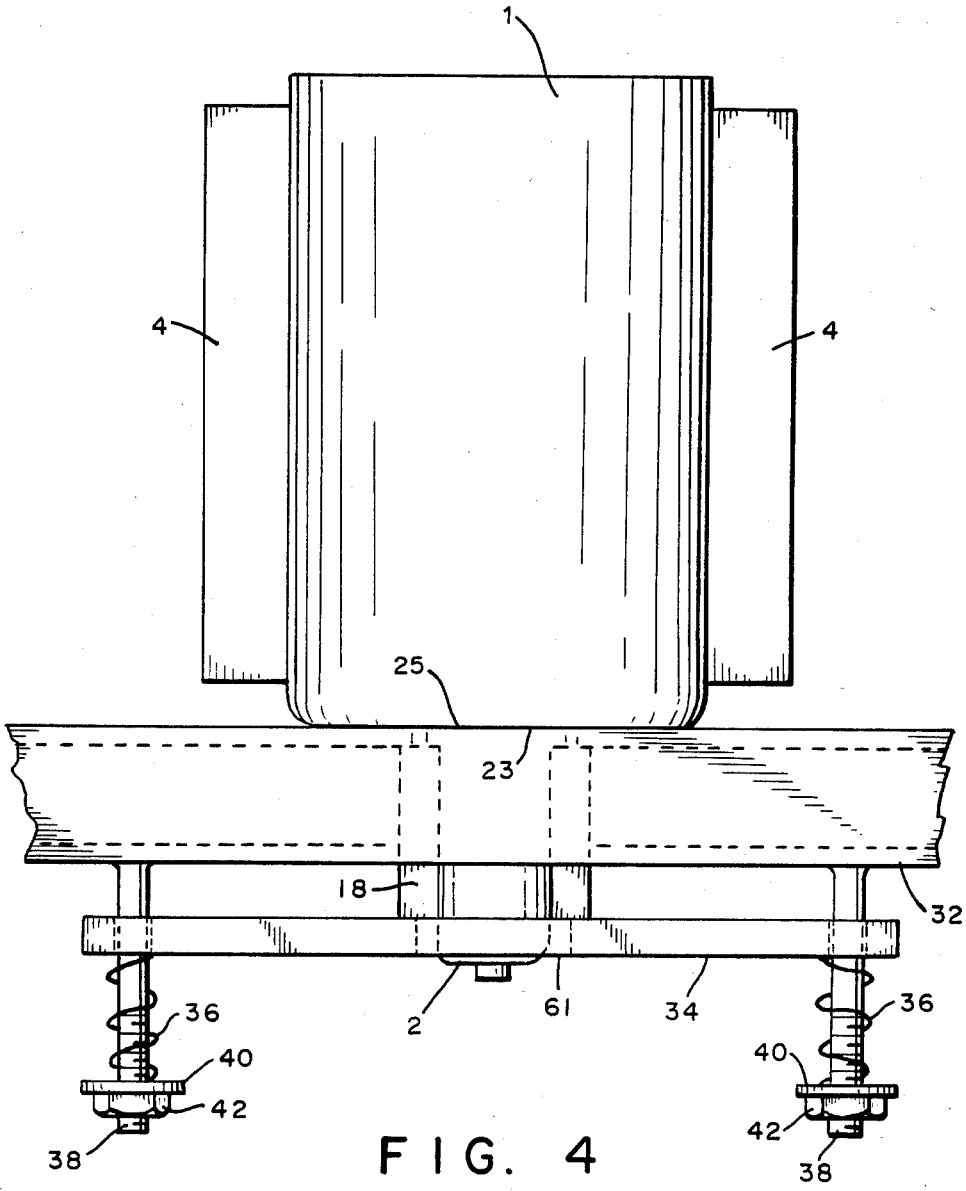
FIG. 4 shows a side elevational view of a nozzle mounted externally to a crucible with a force means comprised of springs.

FIG. 4 shows an embodiment of the invention which employs an optional nozzle heater means 18 disposed about nozzle 2 to preheat the nozzle and maintain the temperature of the molten metal as it passes therethrough. FIG. 4 further shows a force means comprised of springs.

In this embodiment of the invention, a support member, such as frame 32, is configured to be substantially immobile with respect to crucible 1. A displacement member, such as plate 34, is spaced a distance away from support frame 32 and is movable relative to the frame. Spring means, such as compressible springs 36, are operably connected to plate 34 and support frame 32. Springs 36 provide a selected force which is adapted to move plate 34 toward nozzle 2 and resiliently urge the nozzle mounting surface 23 toward crucible mounting surface 25. Adjustment means, comprised of threaded studs 38, nuts 42 and washers 40, adjust springs 36 to provide a selected spring force.

As shown by FIG. 4, threaded studs 38 are attached to frame 32 by suitable attachment means, such as welding. The studs extend through holes in plate 34 and are adapted to slide freely through those holes. Additionally, frame 32 has openings which allow nozzle 2 and heater 18 to extend therethrough without interference from the frame. There is sufficient clearance between nozzle 2 and frame 32 to eliminate any lateral, side to side contact therebetween due to thermal expansion of the nozzle. Plate 34 is adapted to operably contact nozzle heater 18 and move nozzle 2 toward crucible 1. Plate 34 also has an opening 61 therethrough which is configured to allow extrusion of molten metal from nozzle 2 onto a suitable quench surface. A spring 36 and a washer 40 are assembled about each stud 38. Each spring is interposed between a washer 40 and the plate 34, and a nut 42 is then threaded onto each stud 38. Thus, by selectively turning nuts 42 up onto stud 38 to compress springs 36, plate 34 is drawn up against heater 18, which contacts nozzle 2 to urge the nozzle mating surfae 23 toward crucible surface 25 and hold the nozzle and crucible together. By adjusting the amount of compression imparted to springs 36, the amount of mating force can be adjusted to a selected magnitude. The resilience of the springs also allows longitudinal movement of plate 32 along studs 38 in response to the thermal expansion of nozzle 2 and heater 18, and prevents the buildup of excessive stresses within the nozzle.

During certain casting operations, however, the ambient high temperatures, which can exceed 1,000° C., can cause a relaxation of the force exerted by springs 36. The force between nozzle 2 and crucible 1 may become too low to maintain an adequate seal therebetween, and leakage of molten metal may occur.

To minimize this problem, the force means is preferably comprised of a pneumatic actuator mechanism as shown in FIGS. 5 and 6. By employing a pneumatic actuator 46 operated by a pressurized fluid, such as compressed gas, one can advantageously monitor and continuously adjust the gas pressure in the actuator to provide a substantially constant force that operates to hold nozzle 2 and crucible 1 together and maintains an adequate seal therebetween.

As shown in FIG. 5, support frame 32 is substantially immobile with respect to crucible 1 and has openings configured to accommodate placement of nozzle 2 and heater 18 therethrough without interference from the frame. A displacement member is comprised of lever arms 54, a cross member 52 connected between two end portions of the lever arms and a pivot plate 35. The displacement member is movable relative to frame 32. In particular, pivot means, comprised of pivot brackets 52 and pivot bearings 56, connect to support frame 32 and are adapted to pivot the displacement means thereabout. Pivot brackets 52 are rigidly connected to support frame 32 by suitable fasteners or by welding and are adapted to support pivot bearings 56. Pivot bearings 56 pivotably connect each lever arm 54 to its respective pivot bracket 52. A pneumatic actuator means, such as a dual action pneumatic actuator 46, is adapted to pivot the displacement member about the pivot means to move a portion of the displacement member, particularly plate 35, toward nozzle 2. Actuator 46 further provides a selected force that resiliently urges the nozzle mounting surface 23 toward mounting surface 25 of the crucible reservoir to mate and hold the nozzle and crucible together. As illustrated in FIG. 5, actuator brackets 50 are rigidly connected to frame 32 and adapted to support actuator 46. Actuator 46 operably connects to cross member 62 and when operated, provides a force that moves cross member 62 downwards to pivot lever arms 54 about pivot pins 56. As the lever arms rotate, they move plate 35 upward against nozzle heater 18 which in turn, contacts nozzle 2 at nozzle flange 15. The preselected force provided by actuator 46 urges surface 23 toward surface 25 to mate the nozzle and crucible together.

Pressure regulator means 48 controls the gas pressure supplied to actuator 46 to adjust the force directed against heater 18 and nozzle 2. Advantageously, the regulated gas pressure in actuator 46 provides a resiliency which allows thermal expansion of nozzle 2 and downward movement of plate 35 while still maintaining a constant, stable force between nozzle 2 and crucible 1 that is sufficient to preserve the liquid seal therebetween. As a result, leakage is minimized and excesssive thermal stresses that could fracture the nozzle are avoided.

Having thus described the invention in rather full detail, it will be understood that these details need not be strictly adhered to but that various changes and modifications may suggest themselves to one skilled in the art, all falling within the scope of the invention as defined by the subjoined claims.

We claim:

1. An apparatus for casting continuous metal strip comprising:

(a) nozzle means for extruding molten metal, which has a nozzle body, a nozzle inlet opening, a nozzle exit orifice and a substantially planar nozzle mounting surface located on a nozzle flange proximate to said nozzle inlet;

(b) reservoir means in fluid communication with said nozzle means for containing said molten metal, said reservoir means having a reservoir outlet opening for flowing said molten metal therethrough and having a substantially planar reservoir mounting surface located proximate to said reservoir outlet which is adpated to mate with said nozzle mounting surface and allow a relative, sliding-type movement therebetween due to a differing thermal expansion of said nozzle means relative to said reservoir means;

(c) resilient, heat resistant sealing means located between said nozzle mounting surface and said reservoir mounting surface for minimizing molten metal leakage therebetween;

(d) heater means disposed about said nozzle for heating molten metal contained therein; and (e) force means for moving said heater means into contact with said nozzle flange and resiliently urging said nozzle mounting surface toward said reservoir mounting surface to mate said nozzle and reservoir means together.

2. An apparatus as recited in claim 1, wherein said reservoir mounting surface is an outwardly facing surface of said reservoir means and said nozzle mounting surface is a nozzle body surface facing opposite to the direction of the intended flow of molten metal into said nozzle.

3. An apparatus as recited in claim 1, wherein said force means comprises:

(a) support member which is substantially immobile with respect to said reservoir means;

(b) a displacement member which is spaced a distance away from said support member and movable relative thereto;

(c) spring means operably connected to said displacement member and said support member for providing a selected force which is adapted to move said displacement member against said heater means, move said heater means into contact with said nozzle flange and urge said nozzle mounting surface toward said reservoir mounting surface; and (d) adjustment means for adjusting said spring means to provide said selected force.

4. An apparatus as recited in claim 1, wherein said force means comprises:

(a) a support member which is substantially immobile with respect to said reservoir means;

(b) a displacement member which is movable relative to said support member;

(c) pneumatic actuator means for moving said displacement member against said heater means to move said heater means into contact with said nozzle body flange, and for providing a selected force that urges said nozzle mounting surface toward said reservoir mounting surface; and (d) pressure regulator means for controlling a fluid pressure supplied to said pneumatic actuator to adjust said force.

5. An apparatus as recited in claim 1, wherein said force means comprises:

(a) support member which is substantially immobile with respect to said reservoir means;

(b) a displacement member which is movable relative to said support member;

(c) pivot means connected to said support member for pivoting said displacement member thereabout;

(d) pneumatic actuator means for pivoting said displacement member about said pivot means to move a portion of said displacement member against said heater means, move said heater means into contact with said nozzle body flange and provide a selected force that resiliently urges said nozzle mounting surface toward said reservoir mounting surface to mate said nozzle and said reservoir means together; and (e) pressure regulator means for controlling a gas pressure supplied to said pneumatic actuator to adjust said force.

6. An apparatus as recited in claim 1, wherein said sealing means comprises a resilient seal composed of a boron-nitride paste, which allows sliding-type movement between said nozzle and reservoir mounting surfaces due to differing thermal expansions.

7. An apparatus as recited in claim 1, wherein said sealing means comprises a resilient gasket composd of ceramic felt, which allows sliding-type movement between said nozzle and reservoir mounting surfaces due to differing thermal expansions.

8. An apparatus as recited in claim 5, wherein said displacement member comprises a pivot plate connected between two lever arms, said lever arms pivotable about said pivot means, said pivot plate having an opening therethrough that is configured to allow extrusion of molten metal from said nozzle means onto a quench surface, and said pivot plate being movable against said heater means.

9. An apparatus as recited in claim 5, wherein said sealing means comprises a resilient seal composed of a boron-nitride paste, which allows sliding-type movement between said nozzle and reservoir mounting surfaces due to differing thermal expansions.

10. An apparatus as recited in claim 5, wherein said sealing means comprises a resilient gasket composed of ceramic felt, which allows sliding-type movement between said nozzle and reservoir mounting surfaces due to differing thermal expansions.

11. A method for casting continuous metal strip, comprising the steps of:

(a) containing a supply of molten metal in a reservoir means which has a substantially planar reservoir mounting surface located proximate to a reservoir outlet opening;

(b) extruding said molten metal from a nozzle means which is in fluid communication with said reservoir means and has a substantially planar nozzle mounting surface located on a nozzle flange proximate to a nozzle inlet opening;

(c) mating together said nozzle mounting surface with said reservoir mounting surface;

(d) allowing a relative, sliding-type movement between said nozzle and reservoir mounting surfaces due to a differing thermal expansion of said nozzle means relative to said reservoir means;

(e) resiliently sealing the region between said nozzle mounting surface and said reservoir mounting surface to minimize molten metal leakage therebetween;

(f) heating said nozzle means with heating means; and (g) forcibly moving said heater means into contact with said nozzle flange to resiliently urge said nozzle mounting surface toward said reservoir mounting surface and mate said nozzle and reservoir means together.

12. A method as recited in claim 11, further comprising the step of limiting the flow of molten metal from said reservoir means into said nozzle means.

* * * * *